US006543655B1

(12) United States Patent
de Laforcade

(10) Patent No.: US 6,543,655 B1
(45) Date of Patent: Apr. 8, 2003

(54) DISPENSER ENDPIECE HAVING A BREAK-OFF END PART, AND A RECEPTACLE FITTED THEREWITH

(75) Inventor: Vincent de Laforcade, Rambouillet (FR)

(73) Assignee: L'Oreal, Paris (FR)

( * ) Notice: Subject to any disclaimer, the term of this patent is extended or adjusted under 35 U.S.C. 154(b) by 0 days.

(21) Appl. No.: 09/684,423

(22) Filed: Oct. 10, 2000

(30) Foreign Application Priority Data

Oct. 13, 1999 (FR) ..... 99 12762

(51) Int. Cl.[7] ..... B65D 47/10
(52) U.S. Cl. ..... 222/541.9
(58) Field of Search ..... 222/541, 541.5, 222/541.9, 563, 173

(56) References Cited

U.S. PATENT DOCUMENTS

| | | | | |
|---|---|---|---|---|
| 3,366,289 A | | 1/1968 | Badavas et al. | |
| 4,207,990 A | | 6/1980 | Weiler et al. | |
| 5,076,452 A | | 12/1991 | Hashimoto | |
| 5,221,029 A | | 6/1993 | Stull | |
| 5,361,947 A | * | 11/1994 | Lifshey | 222/541 |
| 5,531,707 A | * | 7/1996 | Kers et al. | 222/541 |
| 5,908,124 A | * | 6/1999 | Klauke et al. | 222/541.9 |

FOREIGN PATENT DOCUMENTS

| | | |
|---|---|---|
| EP | 0 076 418 | 4/1983 |
| FR | 2 331 491 | 6/1977 |
| WO | WO 9420379 | 9/1994 |
| WO | WO 9958414 | 11/1999 |

* cited by examiner

*Primary Examiner*—Philippe Derakshani
(74) *Attorney, Agent, or Firm*—Oliff & Berridge, PLC

(57) ABSTRACT

The invention relates to a dispenser endpiece having a break-off end part. The end part includes first grip means enabling the end part to be detached by a first movement, and second grip means enabling the end part to be detached by a second movement, different from the first.

29 Claims, 2 Drawing Sheets

DISPENSER ENDPIECE HAVING A BREAK-OFF END PART, AND A RECEPTACLE FITTED THEREWITH

The present invention relates to a dispenser endpiece having a break-off end part.

BACKGROUND OF THE INVENTION

Numerous dispenser endpieces are known in which the end part is detached from the body of the endpiece by a turning movement about the axis of the endpiece.

In such dispenser endpieces, the end part extends in line with the body of the endpiece, over a zone of weakness.

Those dispenser endpieces give satisfaction when they are made integrally with small flasks packaged in strips and containing small quantities of product.

In contrast, when a receptacle containing a relatively large quantity of product and having a dispenser endpiece that includes a break-off end part as defined above, is placed in a cardboard box with freedom to move inside the box, it has been found that the receptacle striking the walls of the box during transport can cause the end part to tilt about an axis that extends transversely to the axis of the endpiece, and do to so in such an extent as to cause the end part to become detached accidentally.

The resulting leakage can then make an entire batch of goods unfit for sale.

French patent FR 2 331 491 discloses an endpiece having a break-off end part that is suitable for being separated from the body of the endpiece by a tilting movement about a tilting axis perpendicular to the axis of the endpiece.

U.S. Pat. No. 4,207,990 discloses an endpiece including a break-off end part suitable for being separated from the body of the endpiece by a turning movement about the axis of the endpiece.

OBJECTS AND SUMMARY OF THE INVENTION

There exists a need for a dispenser endpiece having a break-off end part that is capable of being opened easily and that is suitable for mounting on a receptacle containing a relatively large quantity of product, but without any risk of the end part becoming accidentally detached during transport.

In the novel dispenser endpiece of the invention the break-off end part has first grip means enabling the end part to be detached by a first movement, and second grip means enabling the end part to be detached by a second movement, different from the first.

Such an endpiece enables the break-off end part to be removed using one hand or both hands, thus making it easier to use.

In a preferred embodiment, the end part can be broken off in response to a turning movement about an axis, and said end part has at least one side portion extending at least in part below the level of the zone of weakness of the end part, giving purchase to the fingers of a user to enable the end part to be turned about the axis of the endpiece, and a transverse portion extending substantially perpendicularly to the axis of the endpiece, giving sufficient purchase to the fingers of a user to enable the end part to be detached by a tilting movement about an axis perpendicular to the axis of the endpiece.

Preferably, the break-off end part has side portions extending at least in part below the level of said zone of weakness.

Because the side portion(s) extend at least in part below the level of the zone of weakness and no longer entirely in line with the body of the endpiece, e.g. being disposed on opposite sides of the body of the endpiece, the end part can be made so that it extends a short distance only beyond the zone of weakness.

This reduces the risk of the end part breaking off accidentally during transport.

In addition, the axial size of a receptacle fitted with the dispenser endpiece remains relatively small, thus making it possible to reduce the size of the box or to have more space available therein for receiving a spacer for braking movement of the receptacle inside the box.

In a particular embodiment, the said side portions are connected to the transverse portion and extend entirely below the level of the top face of said transverse portion.

Preferably, the top face of the transverse portion is substantially plane or slightly convex towards the outside, the shape of the transverse portion advantageously being generally flattened.

Still in a particular embodiment, the transverse portion presents a circular outline when seen from above.

Advantageously, the transverse portion is generally disk-shaped.

Advantageously, the dispenser endpiece has, as the side portions, two diametrically opposite fins disposed in a common plane and extending at least in part on either side of the body of the endpiece.

Preferably, the transverse portion, when seen on the axis of the endpiece, is wider than the top end of the body of the endpiece, and preferably at least three times wider, thereby giving the user sufficient purchase to enable the end part to be detached by imparting a tilting movement about an axis perpendicular to the axis of the endpiece.

Thus, depending on whether the user has one or two hands free, the end part can be detached without significant effort by a turning movement using both hands on the above-specified side portions, or else by causing the end part to tilt using the thumb of a single hand if the other hand is unavailable.

In a particular embodiment, the above-mentioned side portion(s) is/are connected to the body of the endpiece by bridges of breakable material. These bridges increase the ability of the end portion to withstand accidental detachment, specifically by opposing tilting of the end part about an axis perpendicular to the axis of the endpiece.

In a preferred embodiment, the top edge of the or each side portion slopes outwards and downwards.

The invention also provides a receptacle fitted with a dispenser endpiece as described above.

BRIEF DESCRIPTION OF THE DRAWINGS

Other characteristics and advantages of the present invention will appear on reading the following detailed description of non-limiting embodiments and on examining the accompanying drawings, in which.

MORE DETAILED DESCRIPTION

Figure 1:
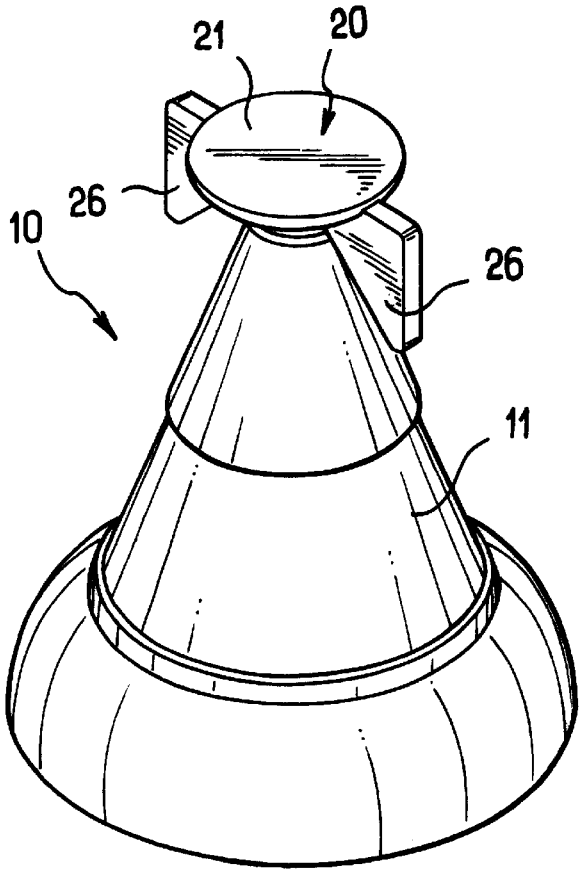
FIG. 1 is a diagrammatic perspective view of a dispenser endpiece of the invention.
Figure 2:
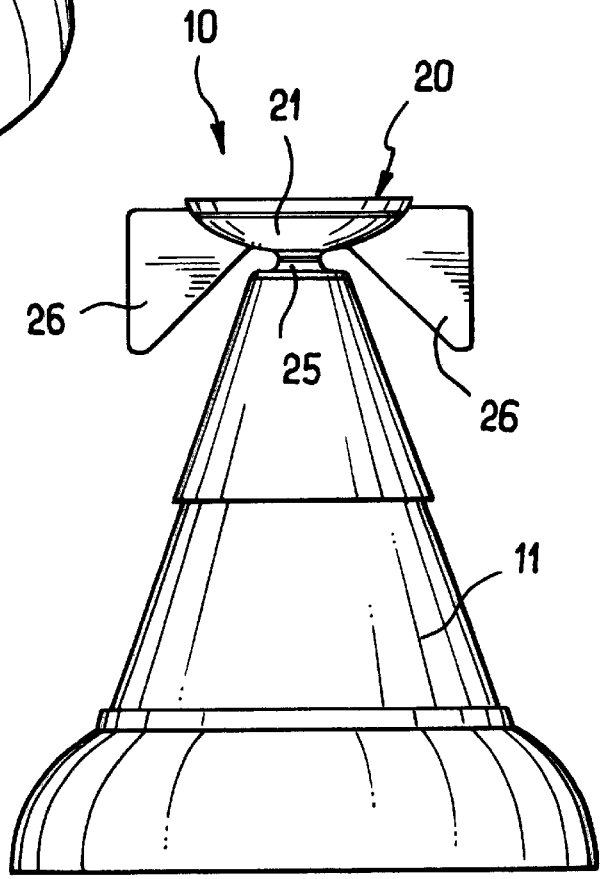
FIG. 2 is a side view of the FIG. 1 endpiece.
Figure 3:
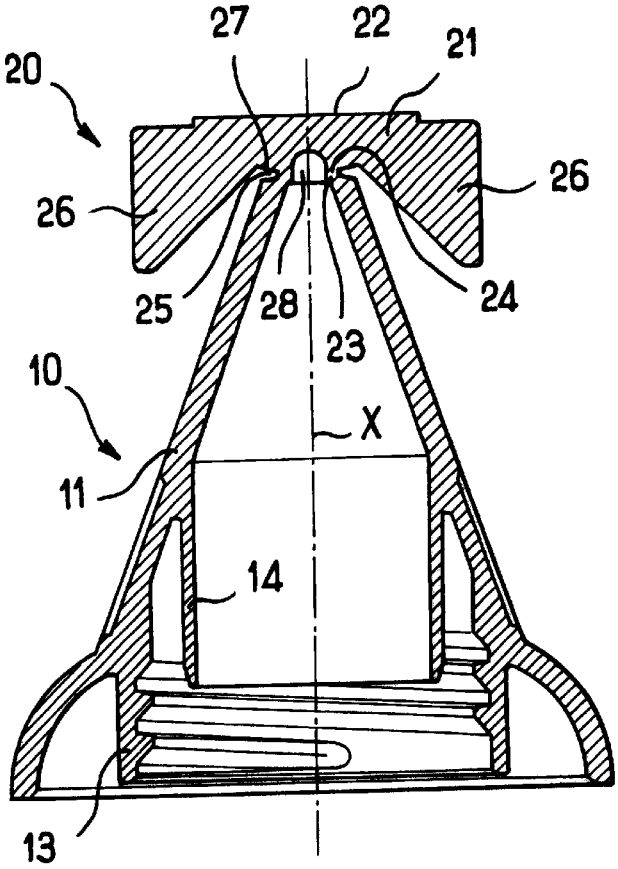
FIG. 3 is an axial section of the endpiece in the join plane.

The dispenser endpiece 10 shown in FIGS. 1 to 3 is made as a single piece by injection molding a plastics material, e.g. polypropylene.

The endpiece 10 comprises a tubular body 11 about an axis X, with the top portion of the body being substantially conical and converging upwards, the body 11 being provided at its tip with a break-off end part 20.

This end part 20 has a central region 21, i.e., a transverse portion, that is generally disk-shaped, with a top face 22 that is substantially plane and perpendicular to the axis X, and connected to the body 11 via a thin annular wall 23 defining a zone of weakness 24.

The convex bottom face 27 of the central region 21 co-operates with the top end of the body 11 to form an annular groove 25 around the thin wall 23.

Two diametrically opposite fins 26, i.e., side portions, are connected to the bottom face 27 of the central region 21 and extend downwards on either side of the body 11, as can be seen more particularly in FIGS. 2 and 3.

These fins 26 are situated entirely below the level of the top face 22 of the central region 21 and they extend in part below the level of the zone of weakness 24.

In the embodiment described, the fins 26 are made in the join plane of the dispenser endpiece 10.

Although they are not on the axis X of the body of the endpiece, the fins 26 are disposed in such a manner as to enable a user to detach the end part 20 by imparting a turning movement about the axis X.

At its bottom end, the body 11 has a first inside skirt 13 which is threaded for screwing onto a receptacle neck having an outside thread, and a second inside skirt 14 for sealing purposes that bears in leakproof manner against the inside surface of the neck once the screw engagement has been tightened.

Naturally, it would not go beyond the ambit of the present invention for the dispenser endpiece 10 to be made integrally with the body of the receptacle instead of being a part that is fitted thereto.

To dispense the product contained in the receptacle, the user holds the receptacle in one hand and uses the other hand to bear against the fins 26 (a first grip means) so as to turn the end part 20 about the axis X (a first movement), thereby breaking the thin annular wall 23 which then defines an orifice 28 through which the product can pass.

In a variant, the user can detach the end part 20 using a single hand by using a thumb to cause the central region 21 (a second grip means) to pivot upwards about an axis perpendicular to the axis X (a second movement).

Figure 4:
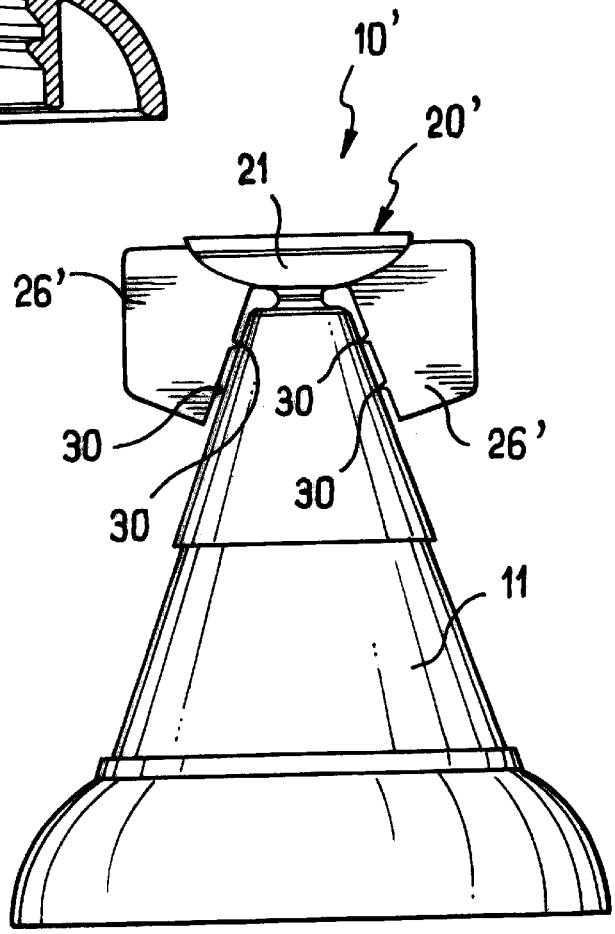
FIG. 4 is a view analogous to FIG. 2 showing a variant embodiment of the endpiece.

FIG. 4 shows a dispenser endpiece 10' constituting a variant embodiment which differs from the preceding embodiment by the fact that the fins 26' are connected not only to the end part 20' but also to the body of the endpiece via bridges of material 30 for breaking on first use.

These bridges of material 30 oppose tilting of the end part 20' about an axis perpendicular to the axis X.

This reduces the risk of the end part 20' being detached accidentally.

Naturally, the invention is not limited to the two embodiments described above. In particular, it is possible to increase the number of fins or to change the shape thereof or the shape of the central region of the end part.

Figure 5:
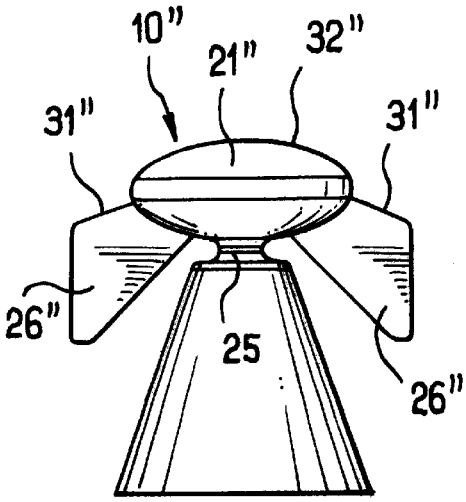
FIG. 5 is a view analogous to FIG. 2 showing another variant embodiment of the invention.

By way of example, FIG. 5 shows an endpiece 10" constituting a variant embodiment in which the central region 21" is of convex lens shape with a top face 32" which is slightly convex in an outward direction.

The fins 26" differ from the fins 26 by the fact that their top edges 31" slope outwards and downwards, thereby further reducing any risk of contact between the fins and outer packaging, and thus reducing any risk of the break-off end part being broken off accidentally.

What is claimed is:

1. A dispenser endpiece including a break-off end part, said endpiece having an axis, wherein said end part has at least one side portion spaced from said axis enabling the end part to be turned about said axis, and a transverse portion extending substantially perpendicularly to said axis enabling the end part to be detached by a tilting movement about an axis perpendicular to said axis.

2. An endpiece according to claim 1, wherein said at least one side portion extends at least in part below the level of a zone of weakness of the end part.

3. An endpiece according to claim 2, having a plurality of side portions extending at least in part below the level of said zone of weakness.

4. An endpiece according to claim 1, wherein said at least one side portion is connected to the transverse portion.

5. An endpiece according to claim 1, wherein the transverse portion has a substantially plane top face.

6. An endpiece according to claim 1, wherein the transverse portion has a slightly convex top face.

7. An endpiece according to claim 1, wherein the transverse portion is substantially disk-shaped.

8. An endpiece according to claim 1, wherein the transverse portion, when seen on the axis of the endpiece, is wider than a top end of a body of the endpiece.

9. An endpiece according to claim 1, wherein the top edge of said at least one side portion slopes outwards and downwards.

10. An endpiece according to claim 1, wherein the end part has two diametrically opposite fins disposed in a common plane, said fins extending at least in part on either side of the body of the endpiece.

11. An endpiece according to claim 1, wherein said end part is connected to a body of the endpiece via a junction zone to define an annular groove.

12. An endpiece according to claim 1, wherein said at least one side portion is connected to a body of the endpiece by bridges of breakable material.

13. An endpiece according to claim 1, the endpiece being made of polypropylene.

14. An endpiece according to claim 8, wherein said transverse portion is at least three times wider than said top end.

15. An endpiece according to claim 1, wherein said at least one side portion extends entirely below the level of a top face of said transverse portion.

16. An endpiece according to claim 1, having a zone of weakness which, after being broken, defines an orifice through which a product can pass and wherein said end part has a top portion wider than said orifice.

17. An endpiece according to claim 1, herein said end part has two diametrically opposite fins and wherein said fins are connected to a body of the endpiece by bridges of breakable material.

18. An endpiece according to claim 1, wherein said transverse portion has a lower face permitting the transverse portion to be grasped by an user.

19. An endpiece according to claim 12, wherein said bridges of breakable material are situated in a common plane.

20. An endpiece according to claim 1, wherein said at least one side portion has a lower edge and wherein the distance between said lower edge and a body of the endpiece increases as the distance between said lower edge and the axis of the endpiece increases.

21. A receptacle having a dispenser endpiece, including a break-off end part, said endpiece having an axis, wherein said end part has at least one side portion spaced from said axis enabling the end part to be turned about said axis, and a transverse portion extending substantially perpendicularly to said axis enabling the end part to be detached by a tilting movement about an axis perpendicular to said axis.

22. A dispenser endpiece including a break-off end part, said endpiece having an axis, wherein said break-off end part has a couple of first surfaces spaced from said axis, said first surfaces being substantially parallel to said axis, enabling the end part to be detached by a first movement, and a second surface being non parallel to said axis, enabling the end part to be detached by a second movement, different from the first.

23. An endpiece according to claim 22, wherein said first movement is a rotation movement about the axis of said endpiece.

24. An endpiece according to claim 22, wherein said second movement is a tilting movement about an axis perpendicular to the axis of said endpiece.

25. endpiece according to claim 22, wherein said second surface is convex toward a body of said endpiece.

26. An endpiece according to claim 22, wherein said second surface is defined by a transverse portion which is, when seen on the axis of the endpiece, wider than a top end of a body of the endpiece.

27. An endpiece according to claim 22, wherein each of said first surfaces is defined by a side portion spaced from the axis of said endpiece.

28. An endpiece according to claim 27, wherein each of said side portions extends at least in part below the level of a zone of weakness of the endpart.

29. A dispenser endpiece including a break-off end part, said endpiece having a first axis, wherein said end part has two fins enabling the end part to be turned about said axis, and a disk-shaped portion enabling the end part to be detached by a tilting movement about a second axis perpendicular to said first axis, and wherein said fins are not connected to a body of said endpiece by bridges of breakable material.

* * * * *